US011768025B2

(12) United States Patent
Thoen

(10) Patent No.: US 11,768,025 B2
(45) Date of Patent: Sep. 26, 2023

(54) COMPARTMENT DRAWER REFRIGERATOR FREEZER

(71) Applicant: Stephanie E Thoen, Colorado Springs, CO (US)

(72) Inventor: Stephanie E Thoen, Colorado Springs, CO (US)

( * ) Notice: Subject to any disclaimer, the term of this patent is extended or adjusted under 35 U.S.C. 154(b) by 91 days.

(21) Appl. No.: 17/649,320

(22) Filed: Jan. 28, 2022

(65) Prior Publication Data

US 2022/0252323 A1 Aug. 11, 2022

Related U.S. Application Data

(60) Provisional application No. 63/200,042, filed on Feb. 11, 2021.

(51) Int. Cl.

| | |
|---|---|
| ***F25D 11/02*** | (2006.01) |
| ***F25D 17/04*** | (2006.01) |
| ***F25D 25/02*** | (2006.01) |

(52) U.S. Cl.

CPC ..... *F25D 17/045* (2013.01); *F25D 11/02* (2013.01); *F25D 25/025* (2013.01); *F25D 2700/121* (2013.01)

(58) Field of Classification Search

CPC ..... F25D 11/02; F25D 13/04; F25D 17/045; F25D 17/065; F25D 25/025; F25D 2700/121

See application file for complete search history.

(56) References Cited

U.S. PATENT DOCUMENTS

| | | | | |
|---|---|---|---|---|
| 9,510,696 | B2 * | 12/2016 | Lee | A47F 3/043 |
| 9,897,370 | B2 * | 2/2018 | Gillette | F25D 25/025 |
| 10,281,193 | B2 * | 5/2019 | Choi | F25D 11/00 |
| 2008/0178621 | A1 * | 7/2008 | Kang | F25B 5/04 62/186 |
| 2009/0044556 | A1 * | 2/2009 | Ihle | F25D 21/04 62/449 |
| 2010/0308705 | A1 * | 12/2010 | Kwon | F25D 25/024 312/404 |
| 2015/0107285 | A1 * | 4/2015 | Mitchell | F25D 23/04 312/405.1 |
| 2020/0000113 | A1 * | 1/2020 | Eaton | F25D 17/042 |
| 2021/0076862 | A1 * | 3/2021 | Gardner | F25D 17/04 |
| 2021/0396449 | A1 * | 12/2021 | You | F25D 17/065 |

* cited by examiner

*Primary Examiner* — Filip Zec

(74) *Attorney, Agent, or Firm* — Law Office of Scott C Harris

(57) ABSTRACT

A multiple drawer refrigerator, where each drawer is separately controllable to a temperature for a refrigerator or a freezer. Each drawer is isolated from all the other drawers, so that items in one drawer do not leech smells to another drawer, and so that opening one drawer does not release cold air from the other drawers.

11 Claims, 11 Drawing Sheets

COMPARTMENT DRAWER REFRIGERATOR FREEZER

This application claims priority from provisional application No. 63/200,042, filed Feb. 11, 2021, the entire contents of which are herewith incorporated by reference.

BACKGROUND

There is a wide variety of refrigerators and freezers to choose from on the market. A typical maximum door availability is 4 doors with two external drawers.

As soon as a refrigerator door is opened, the cold air from inside the refrigerator sinks to the floor of the room containing the refrigerator. This necessitates extra energy to re-warm the home if in heating season, and extra energy to re-cool the refrigerator to its set point.

This challenge is especially pronounced when the refrigerator is located in RVs or tiny homes where energy conservation is of utmost importance, especially those that are mobile or off grid.

SUMMARY OF THE INVENTION

The inventor recognized limitations in the current designs of a refrigerator.

An embodiment describes a refrigerator that has multiple different separated compartments, each compartment being temperature isolated from other compartments, and each compartment being separately controllable. In an embodiment, each compartment has its own drawer that can be opened by sliding out. As such, this introduces an all drawer compartment refrigerator freezer with separately controllable sections, where each separated compartment can be configured as either a refrigerator or a freezer, and each separated compartment can be controlled separately to be lockable.

The present inventor addresses problems in current refrigerator-freezer design, using full drawer refrigerator freezer units and/or individually customizable temperature control zones for all or many doors and drawers.

The all drawer style refrigerator according to embodiments described herein defines compartments, where the cold air of the refrigerator is contained within each single compartment. Users can access only the items they want, without having to subject all of the refrigerator inside, and hence its food, to fluctuating temperatures. The drawer system enables increased energy efficiency, reducing the energy necessary to re-cool the entire refrigerator and exhausting less cold air into the accompanying vicinity of the refrigerator, e.g the home surrounding the refrigerator.

An extra advantage is obtained that this modular design eliminates cross contamination of odors and flavors between different foods in different sections of the refrigerator.

An additional feature for any mobile home is that the current design can confine food and beverages in place and allows limited shifting of refrigerated products during turning and braking of the home, as would happen in a traditional door accessible refrigerator.

Additional features are described herein.

BRIEF DESCRIPTION OF THE DRAWINGS

In the Drawings.

The figures show aspects of the invention, where.

DETAILED DESCRIPTION

The present application describes an all drawer compartment refrigerator freezer with individual zone controls for each compartment.

My drawer system will provide for more storage being utilized and food being able to last longer by avoiding temperature and humidity fluctuations. Another advantage is that drawers can be converted to different uses. For example, if you eat more fruits and vegetables, you can convert more drawers for refrigerator use to hold the fruits and vegetables. If you need more freezer space, you can switch additional drawers to freezer mode with a simple control, e.g., push of a button.

In embodiments, a drawer system is used which provides for better utilization of storage, and also enables the food to last longer, because there are more targeted sections. Since only a small section of the refrigerator inside is opened to the ambient atmosphere at any one time, there are less temperature and humidity fluctuations.

In an embodiment, each drawer can be changed between refrigerator and freezer. In this way, a user can easily apportion between the amount of space that they want for refrigerator space and for freezer space.

By pulling out drawers, users can more easily see what is in the compartment. In a conventional shelf refrigerator, forgotten food is often pushed to the back. The drawer system can be pulled out, and hence allows the entire drawer contents to be seen.

In addition, by using door labels or electronic displays as described herein, users can annotate the outside of the refrigerator to display contents that are in the drawers, without requiring the user to open those drawers. For example, a user can dedicate a drawer for leftovers or children's snacks.

As described herein, different embodiments include vertical and horizontal drawers to maximize space and ease of use for different kinds of food storage.

Different embodiments have a variety of widths and heights, enabling same sized items to be placed together for best utilization. The amount and size of drawers is dependent on the appliance's overall dimensions.

Individual drawer locks can be accessed by code, phone app, or fingerprint, as examples. This allows safe storage of glass items, medications or alcohol without allowing child access.

In an embodiment, each drawer has heavy duty, soft closing drawer slides that can hold heavy items. Each drawer is configured to fully pull out, maximizing the accessibility.

Another benefit to an all-drawer system is to eliminate the additional space that is required for swinging doors. A drawer does not block a specific direction, and hence there is never a need to change the orientation of the door. The drawer only requires space to slide, so it can be put it up against a wall or a cabinet without interference. This will allow for many more options in kitchen designs.

In one embodiment, the drawers can be made into unique shapes instead of a traditional rectangular shape.

Figure 1:
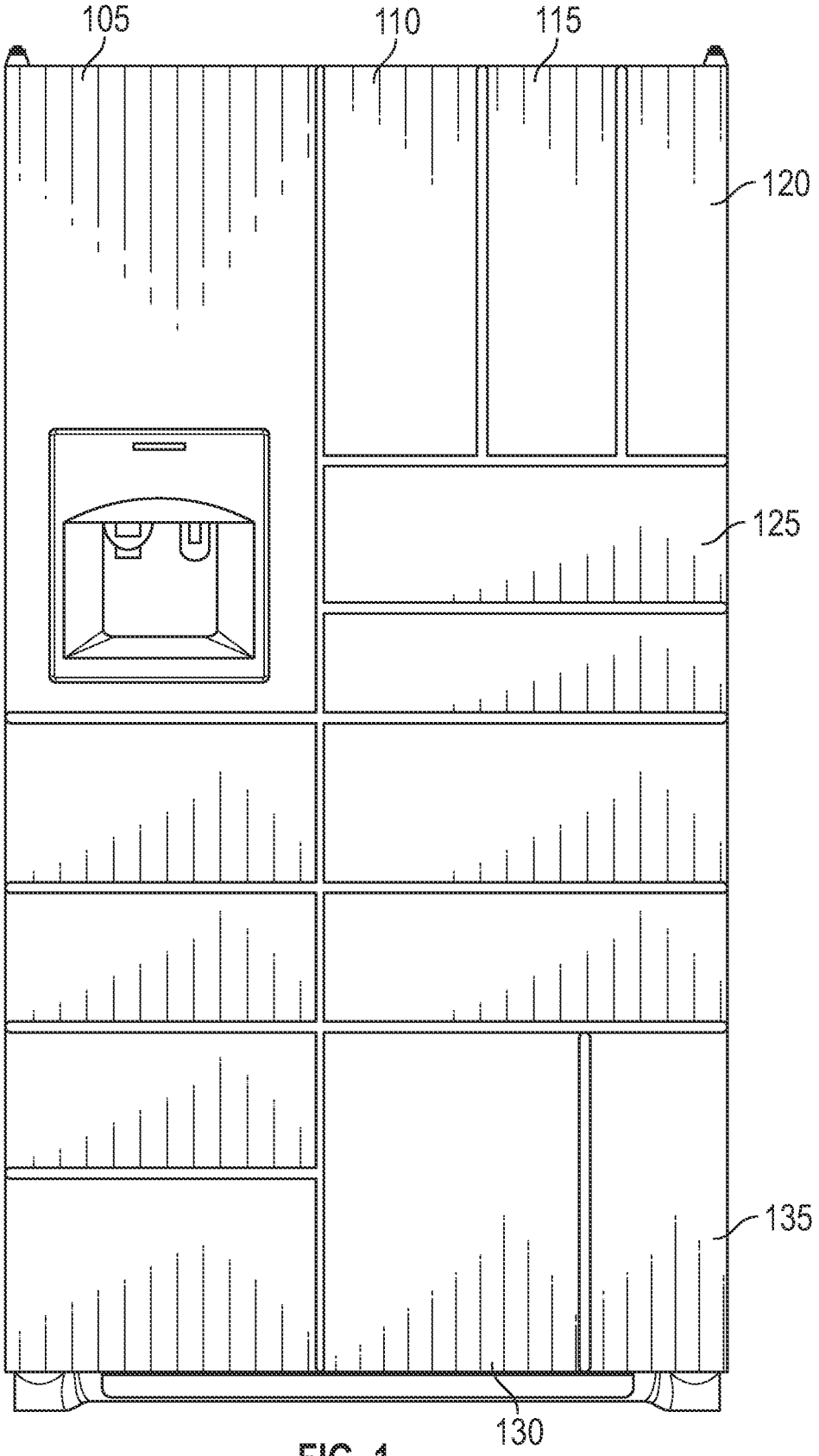
FIG. 1 shows a first configuration of drawers in a multiple drawer refrigeration system which forms a refrigerator and freezer out of any of the drawers.

An embodiment, shown in FIG. 1, illustrates the drawer compartment style refrigerator and freezer. Instead of doors, each compartment is formed of pull out drawers. Each drawer is a self contained unit, formed with a customizable temperature and humidity level.

FIG. 1 shows one embodiment, but it should be understood that any drawer can be any size, and that each of the drawers can hold different things than those described.

In the embodiment of FIG. 1, the top left drawer 105 is a "big" section, for big items such as watermelons, casserole dishes, and the like. That big section 105 can also have, as shown, an area enabling water or ice distribution.

Also on top of the refrigerator are alternative drawers including a condiment and dressings drawer 110, a tall beverages drawer 115, and a special can storage drawer 120 which is described in further detail herein. The can storage drawer is removable and adjustable. The can storage drawer allows items to be stored horizontally while filling from the top and dispensing from the bottom as described herein.

Other drawers such as 125 can open outwardly to allow different items to be put therein. A large frozen item drawer 130 can take large frozen items such as turkeys, hams and large pieces of meat or any other large item. 135 can represent a tall frozen food box drawer, such as for pizza.

The drawers can be in any desired configuration. In FIG. 1, there are 5 stacks of drawers on the left and 6 stacks on the right.

Any drawer can be maintained at any desired temperature is controlled using the control system, described herein.

Figure 2:
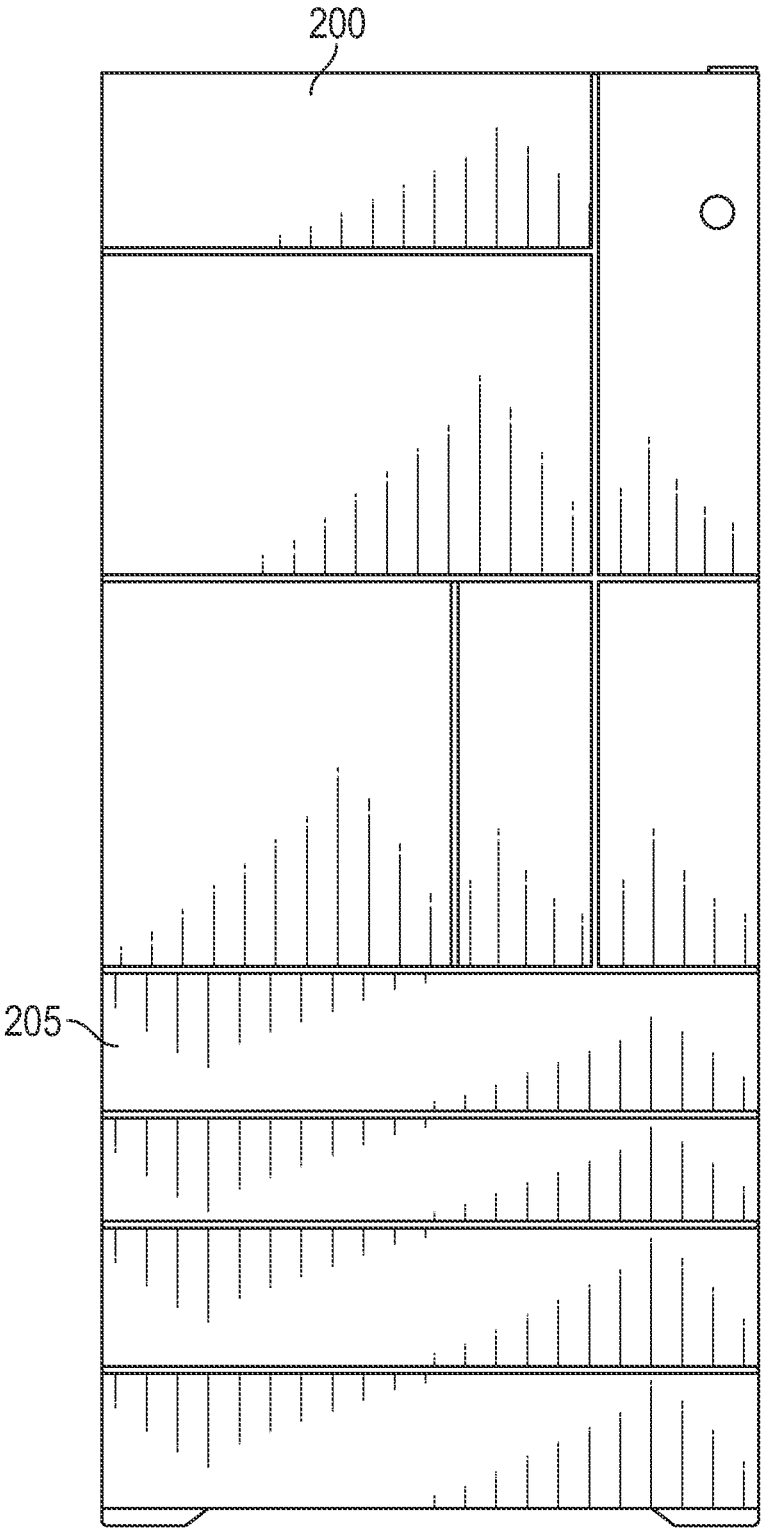
FIG. 2 illustrates an alternative configuration of drawers in an alternative refrigerator system.

As illustration that other embodiments can have different drawer configurations, FIG. 2 shows alternate drawer configurations, with wider drawers 200 at the top and full length drawers towards the bottom 205.

Figure 3:
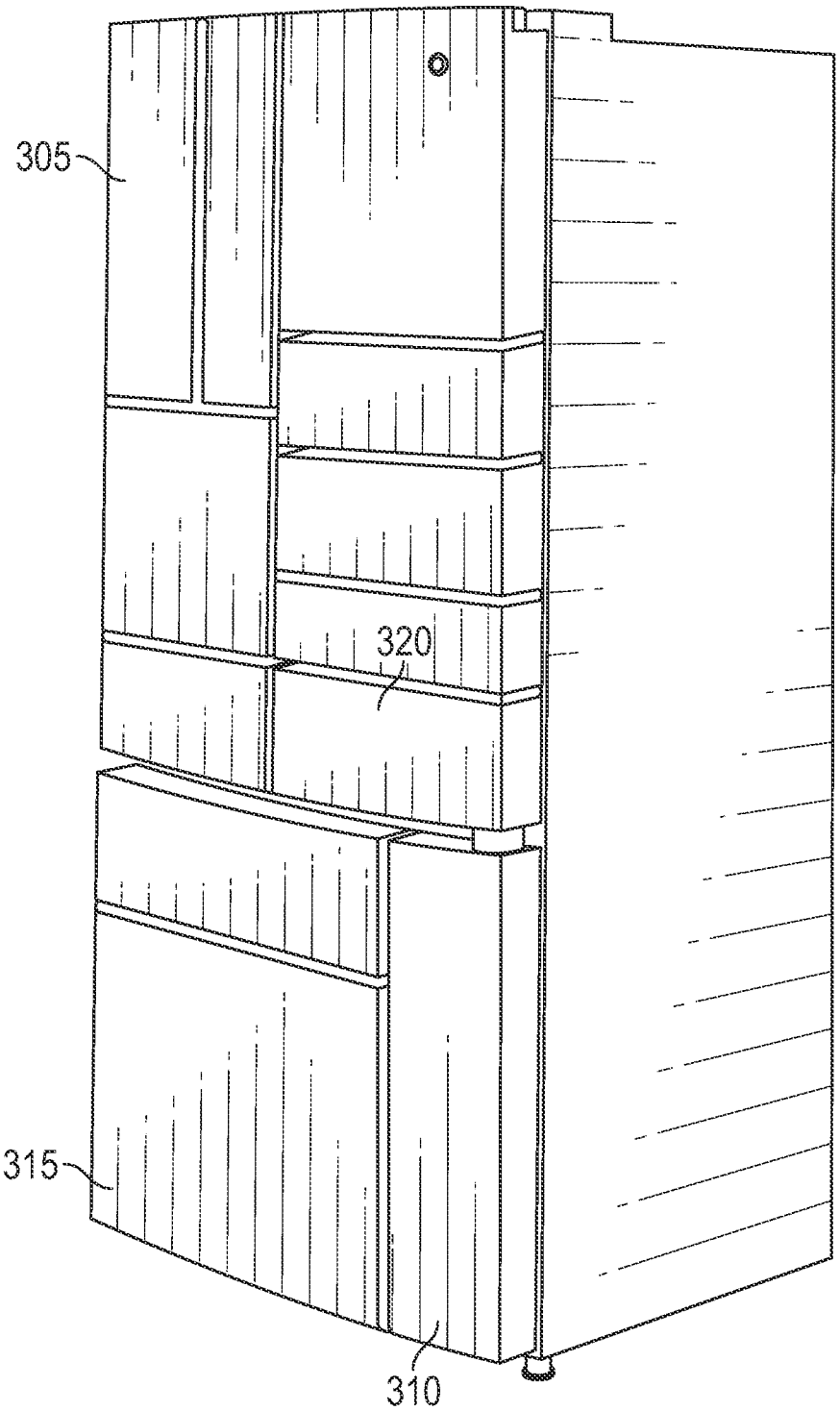
FIG. 3 shows an additional alternative configuration of drawers.

Another example drawer configurations is shown in FIG. 3. This has slight of hold drawers, such as 305 and 310, and other sliding doors of other sizes, such as the large drawer 315, and thinner drawers 320.

In embodiments, there can be multiple different size refrigerator systems. A standard home size refrigerator of 66-72 inches high, by 29-36 inches wide may be considered a home size refrigerator.

Another embodiment describes a smaller refrigerator system tailored for apartments, for example 61-66 inches high by 28-32 inches wide.

Another embodiment uses these techniques in a dorm room size refrigerator 34-56 inches high by 18-23 inches wide.

Another embodiment describes a half depth bookshelf size refrigerators. This can be approximately 13-15 inches wide, can have a sliding mechanism on top to function like a barn door allowing additional storage behind the refrigerator such as pantry, linen, laundry or a false wall. This can alternatively have wires centered on the top and can rotate 180° to turn into another room or reveal additional storage on the other side.

In embodiments, all drawers can be a push in style that automatically pops open and stays shut via a magnet, similar to vanity mirrors and desk drawers. The drawers also include a spring loaded plunger, that is pushed in to release and cause a spring force to push open the drawer.

Figure 1A:
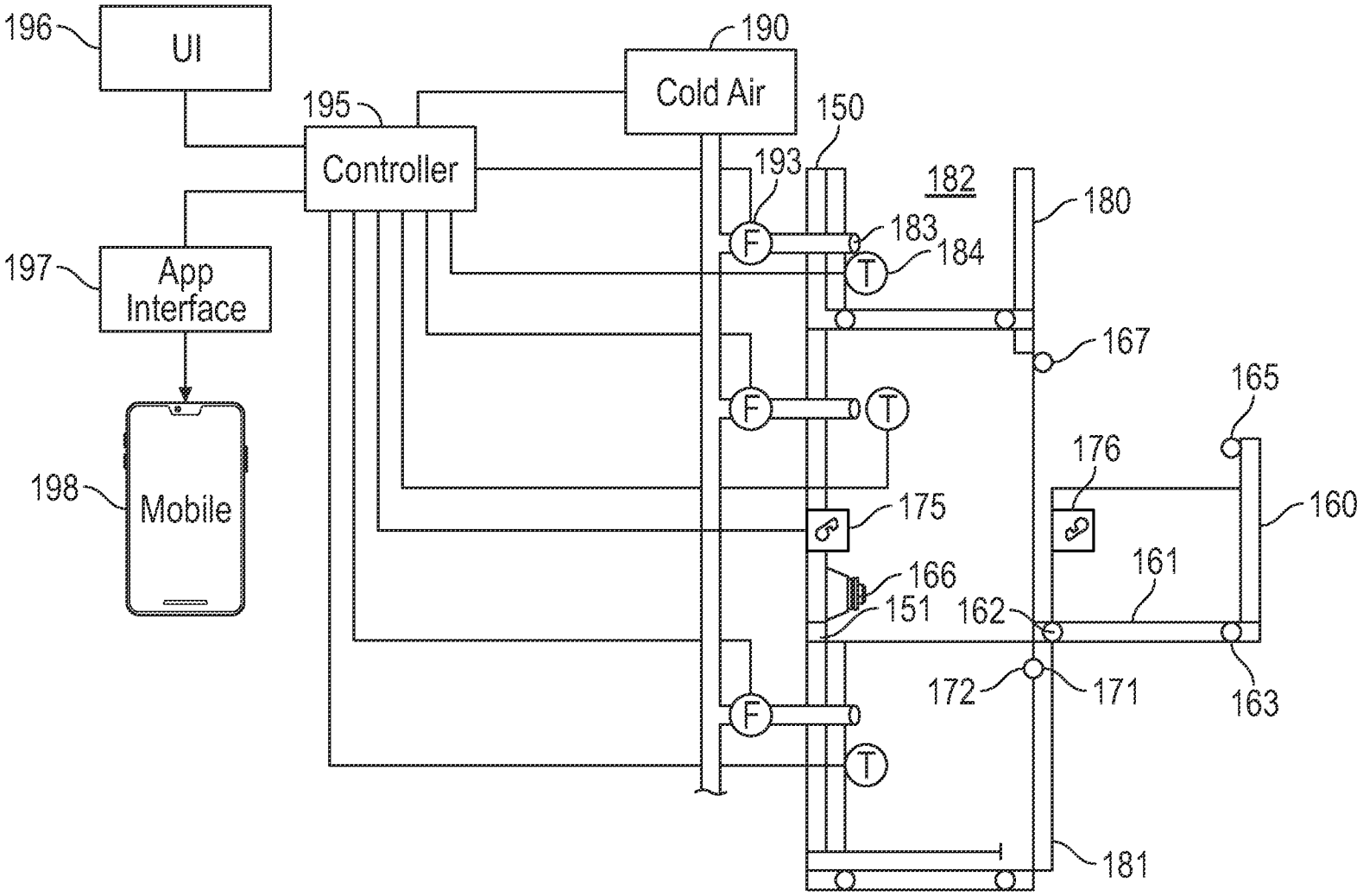
FIG. 1A shows a side view of certain drawers, and shows a block diagram of the control circuitry for controlling the individual cooling and locking of the drawers.

FIG. 1A shows a side view of the pullout drawers. In FIG. 1A, the rear wall of the refrigerator shown as 150 includes support structure, including a connection such as 151 on which the drawers such as 160 can roll in and out. The connection 151 connects to an extendable drawer connection 161, which enables the drawer 160 to roll in and out on his rollers 162, 163. The drawer connection extends, and also folds back into place into the position of drawers such as 180 and 181. The drawer includes a magnetic part 165 which holds against a corresponding magnet 166 that is located on the top structure of the drawer opening support. When the drawers are closed, such as the drawer 181, then the drawers magnet 171 presses against the magnet 172 on the refrigerator structure, and the drawer extension is held in closed.

Each of the drawers also includes a spring loaded plunger, shown as 166. When the spring-loaded plunger is slightly depressed, it releases an internal spring to provide spring force to force the drawer towards the open position. In this way, all the drawers can be opened and closed without dedicated handles.

Alternately, some or all of the drawers can have handles.

In one embodiment, all of the drawers also have electric locks, that are electrically lockable and releasable. The lock is formed of a locking portion 175, which connects to a corresponding lock portion 176 on the drawer. When the drawer is locked, the portions 175 and 176 hold to one another, and prevent the drawer from opening. The drawers can be set to automatically lock, or can be individually locked. This can be done for child safety and which prevents the drawers from sliding open during the transport.

FIG. 1A also shows how the cold air supply 190, e.g. a refrigerator compressor and condenser, has its cold air output individually routed to each compartment.

Each compartment, such as 180, has an individual cold air output 183 exhausting into the cooled area 182 of the compartment. A thermostat 184, monitors the temperature of the compartment interior 182. The thermostat 184 provides its output to the controller, which monitors the drawer temperature, to maintain the drawer temperature at a desired level. If the drawer is configured to be a refrigerator, then the temperature is maintained the temperature of the interior 182 of the drawer is maintained at a level that will maintain refrigerator temperature therein. When the temperature from thermostat 184 gets to be too low, then the controller 195 provides cold air from the compressor 190 into the interior of the compartment, by turning on the cold air gate 193, where the cold air gate can be, for example, a valve or a fan. The valve 193 can be automatically open by an amount which allows cold air to enter the compartment interior 182. For example, valve 193 can be open by a first amount when the compartment is set as a refrigerator and by a second amount when the compartment is set as a freezer.

The controller 195 also determines on-and-off the compressor itself, for example when old drawers reach an acceptable temperature, the compressor is turned off until the next cooling cycle.

The controller also deceives input from the user interface 196, which can be one or more local touchscreens which control the characteristics of the different compartments. This can control, for example, whether a compartment is a refrigerator or freezer, can control the lock status of the compartment (locked, unlocked, or unlocked for one hour, for example) and can control lighting in the compartments.

There is also an app interface 197, which communicates with a mobile device 198, to allow control of the refrigerator characteristics from the mobile device In another embodiment, there can be a child snack drawer allowing children to access their specific items at will.

Figure 4:
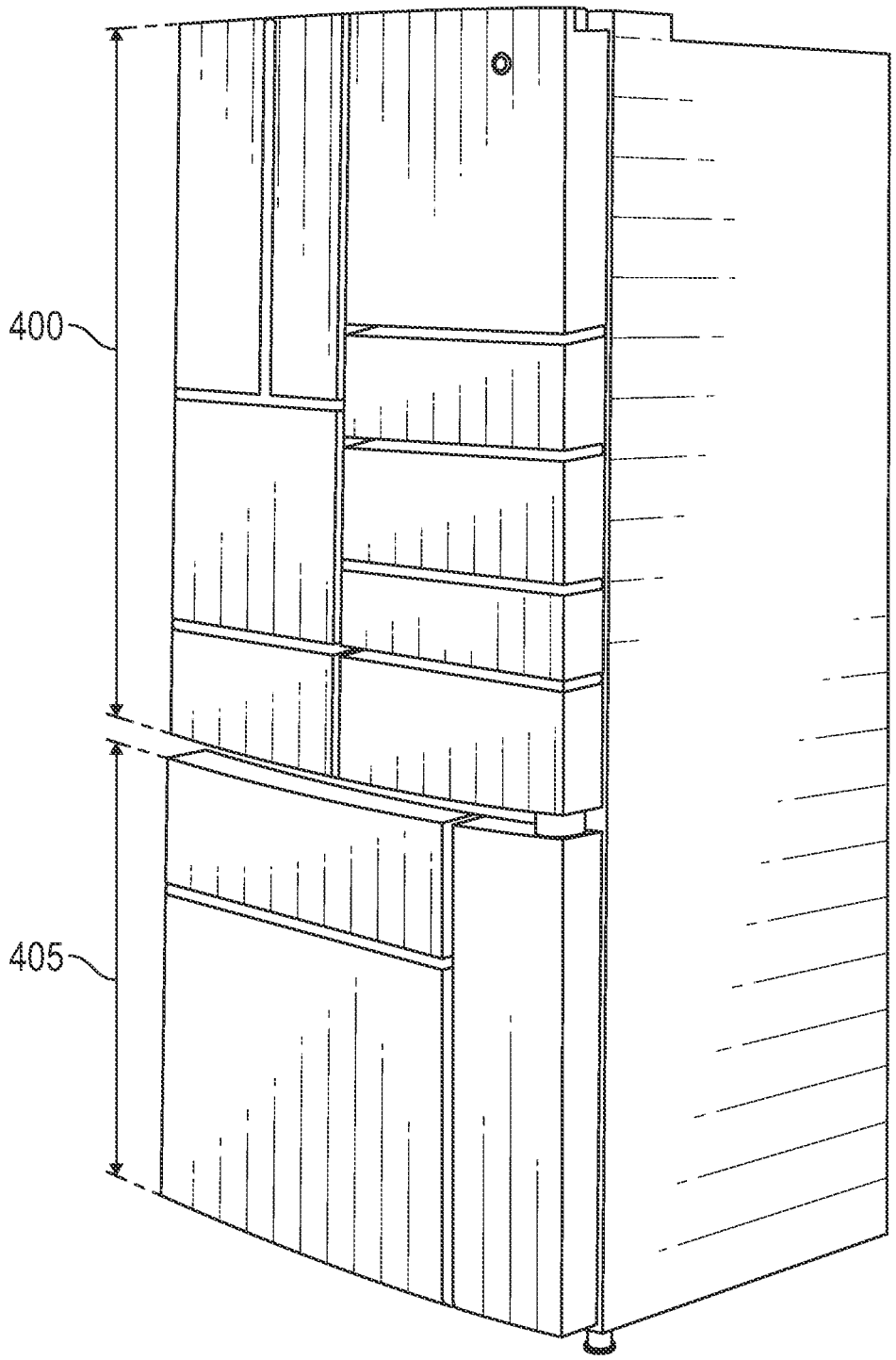
FIG. 4 shows an alternative configuration where sections comprising multiple drawers are separately controllable.

In an alternative embodiment, each drawer is not individually temperature controlled, and the system has zones for the various drawers. A two zone embodiment is shown in FIG. 4, where the drawers in the top portion 400 are configured as refrigerator drawers, and the drawers in the bottom portion 405 are configured as freezer drawers.

Figure 5A:
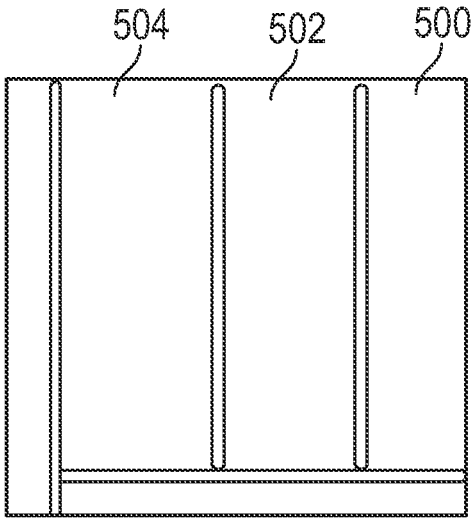
FIGS. 5A and 5B show an adjustable beverage storage system for use in the refrigerator.
Figure 5B:
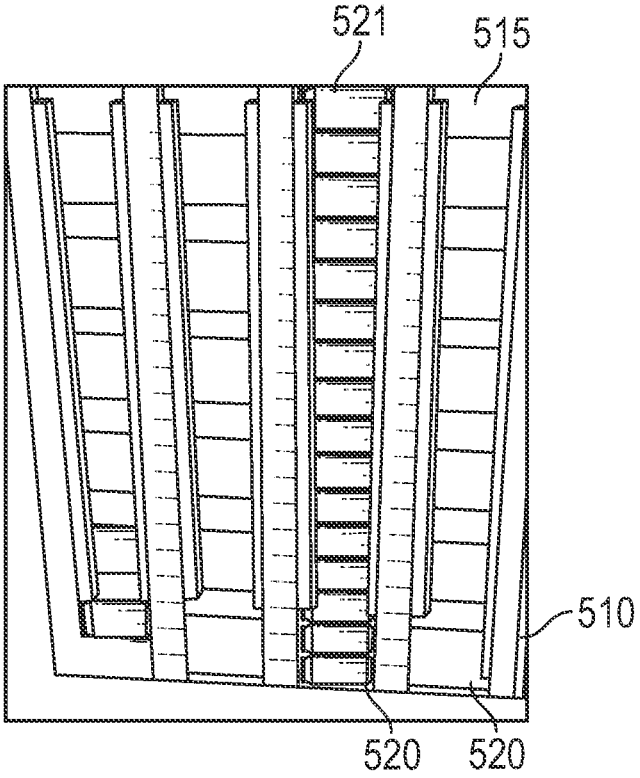

In an embodiment, removable and adjustable beverage can and bottle units can allow for items to be stored horizontally, as shown in FIGS. 5A and 5B. As shown in FIG. 5A, there can be a number of different tall drawers such as 500, 502, 504. Each of these drawers can separately opened, to reveal the inside. For example, the can storage system 500 can open to reveal a structure such as shown as 510, where the can system fills from the top 515, and dispenses from the bottom at 520. This system can be formed of plastic or metal, allowing beverages such as in cans 521 to be stored horizontally, thus maximizing the space and allowing able to the ability to get and see items easily.

Each drawer front includes a labelling capability on the outside of the drawer. This enables a user to write a note indicating interior contents, or enter that on a programmable electronic display screen.

This can be integrated with the temperature control display and the drawer locking function.

Figure 6:
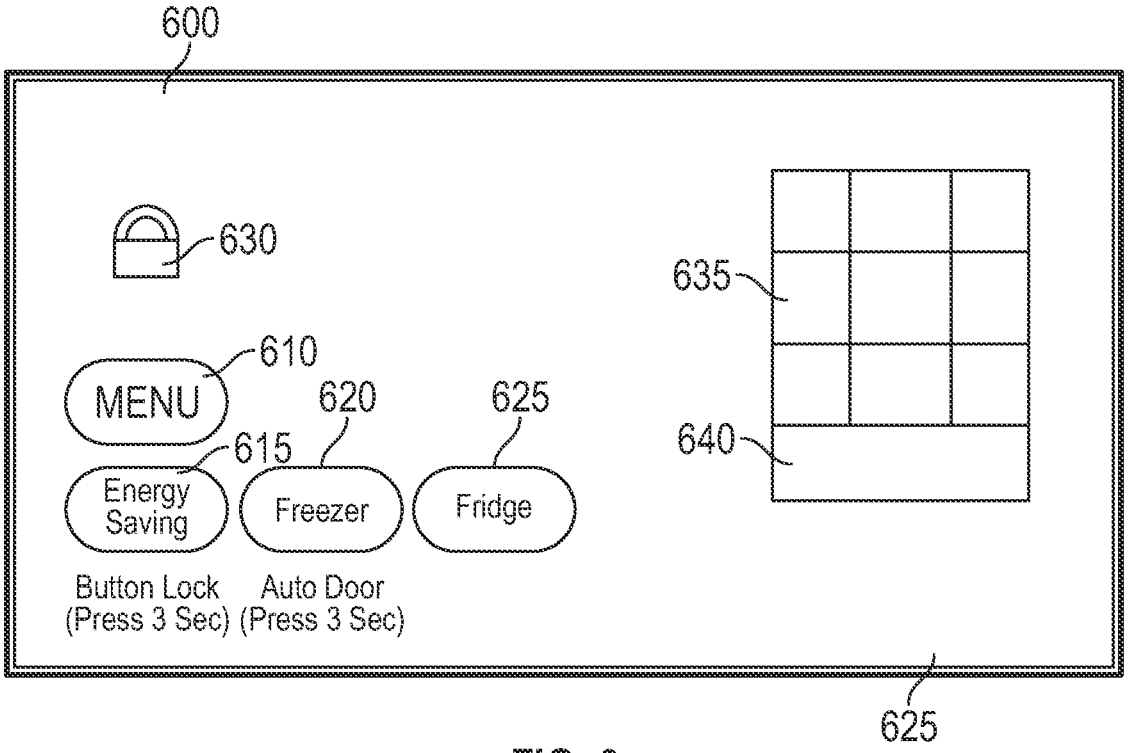
FIG. 6 illustrates an exemplary touchscreen controller.

FIG. 6 illustrates an embodiment of the touch screen controller 600, showing the controls for menu 610, energy-saving 615, freezer mode 620 or fridge mode 625. The mode for the selected drawer or compartment is in bold, and the nonselective mode is shown as grayed out. There is also a keyboard 635, and a display 640.

A lock icon 630, enabling the selected door to be locked. In an embodiment, there is a touch screen associated with each individual drawer.

In another embodiment, a touchscreen may be associated with a group of drawers, or may be programmable so that there is a touchscreen that can be used for any drawer. There is a touch keyboard 635 and display 640 for example that enables reconfiguring the touchscreen controller, such that for example the touchscreen controller can be programmed to be operable with a particular drawer. FIG. 6, for example, shows drawer 4 being currently selected. Once the drawer is selected, the user can adjust the characteristics of the drawer, for example changing it from fridge to freezer, turning on energy saving, and locking or unlocking the drawer. The user may be required to enter a special code in order to make any changes, in order to avoid unintentionally changing the drawer from refrigerator to freezer, which could have disastrous consequences for the food in the compartment, when done unintentionally.

For example when one wants to modify the condition of a drawer, either the temperature or lock condition or some other condition of drawer number 4, the user can enter 4 on the keyboard, and that will configure the touchscreen controller to control the control circuitry for the door number 4.

The display illuminates when touched and remains off normally. In an embodiment, the touch screen can be programmed in multiple different languages, configurable via the menu button. Alternately, the system can allow any language commands to be received.

Once parameters have been entered on the controller, they are saved in nonvolatile memory, and the drawer is maintained in that configuration until new configuration requests are made.

As an alternative, this can use a master controller or multi door controller instead of this single controller per door.

In other embodiments, the drawer, once locked, can require a combination, or controlled from a phone app or other actions to unlock it. This enables locking each of the compartments separately.

Figure 7A:
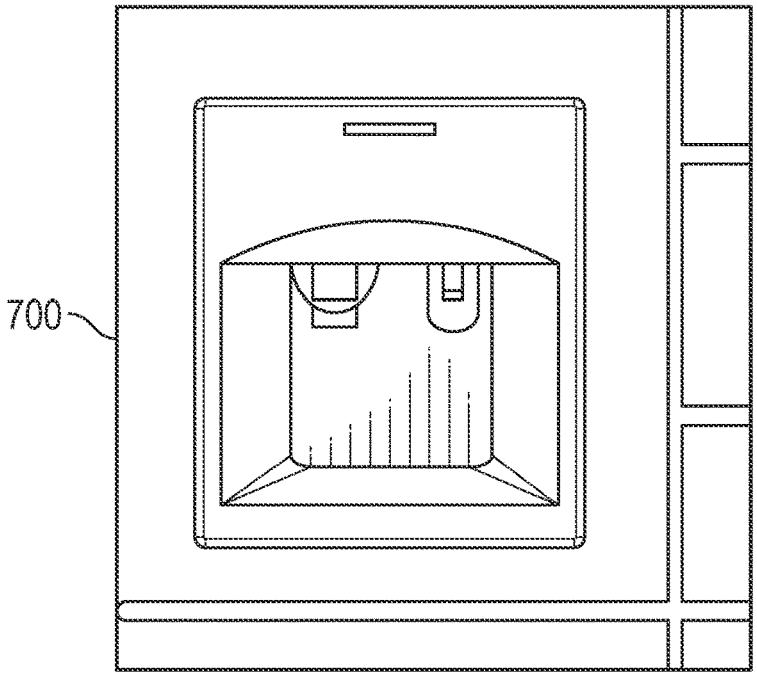
FIGS. 7A and 7B show a front on view and side on view respectively of the water and/or ice dispenser for use in the drawer system.
Figure 7B:
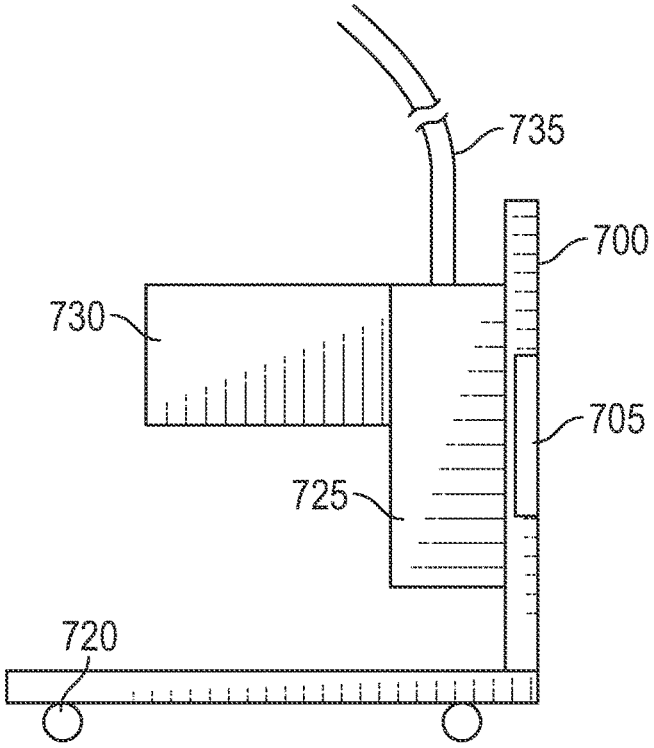

One embodiment enables one (or more) of the drawers to include a water and ice dispenser as shown in FIG. 7 as 700. FIG. 7B shows a side on view, showing the door 700 with the ice dispenser 705 located on a wheeled track 720. The dispenser itself 725 is behind the door, and attached to an ice holding part with an icemaker 730. A waterline 735 comes in as a flexible intake, delivering water to the icemaker, but still allowing the compartment to be moved in and out.

Figure 8:
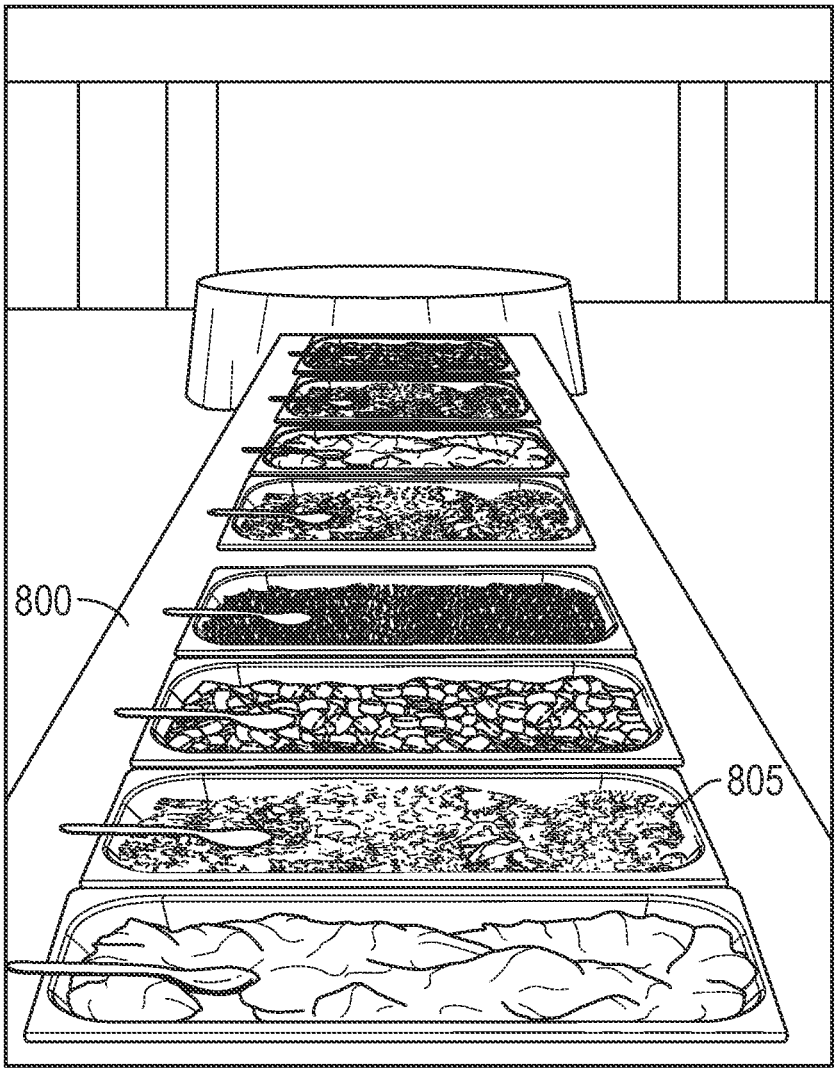
FIG. 8 illustrates a drawer with a buffet tray style operation.

An insert 800 for removable buffet trays 805 such as the type shown in FIG. 8 can be included in some or all of the drawers. These buffet trays can be covered, and can allow food to be held within the refrigerator, and dispensed as needed. Since opening a drawer does not cool the entire refrigerator, the drawer can be held open while the food is dispensed from the buffet tray. Moreover, since the insides of the compartments are not connected to one another, food can be left within the buffet tray without its smells from the food reaching other places in the refrigerator.

Figure 9:
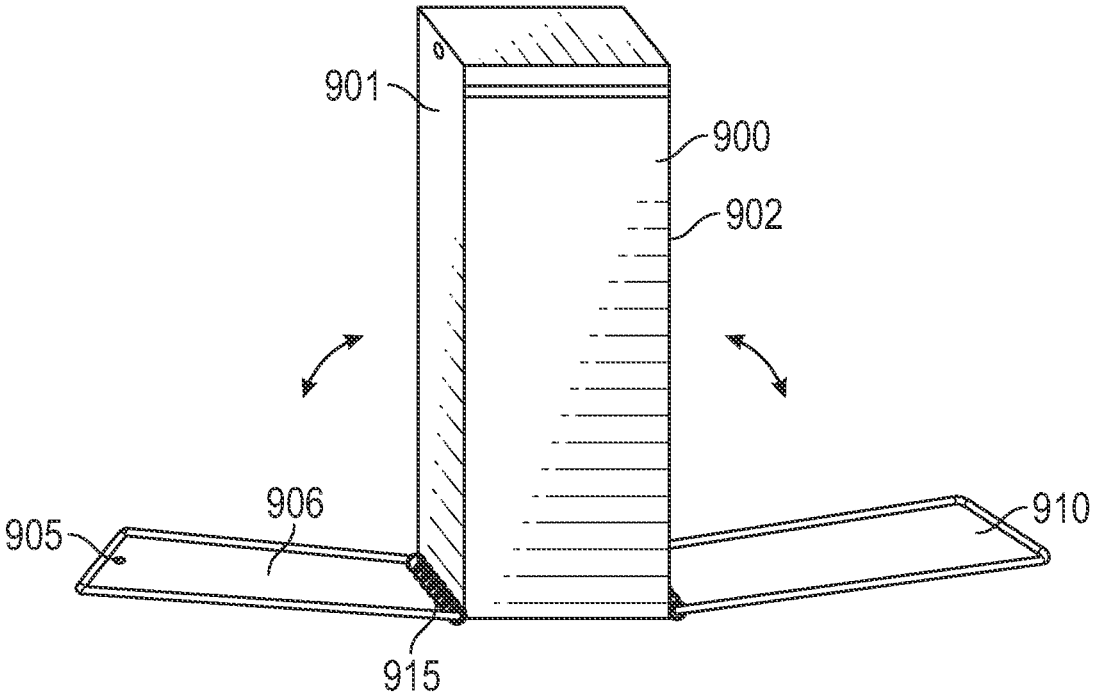
FIG. 9 shows a side system for a vertical drawer.

FIG. 9 illustrates the front of a vertical compartment front 900, where this is for a vertical drawer that is taller than it is wide, such as the drawer 110 in FIG. 1. The drawer 900 has foldable side flaps 905, 910. Each flaps such as 905 is connected via a hinge 915 to the side of the drawer, which enables the flap 905 to fold down as shown in FIG. 9 to form a horizontal surface, or to fold up to allow the drawer sliding in and out, where the top surface 906 of the flap presses hard against the side surface 901 of the drawer. One or more of the sides can be folded down, to form a horizontal surface, for ease of loading and unloading items. The door can be clipped back into the upright position before closing the drawer. This simplifies the loading and unloading operation.

In operation, the flaps 905 and 910 are pressed tight against the sides 901, 902 of the drawer when the drawer is folded into the refrigerator, and can be folded down into the position shown in FIG. 9 when the drawer is rolled out from the refrigerator. Again, since each section of the refrigerator is isolated from other sections, a cooling amount lost when the drawer is open is minimal, enabling a simplified loading operation.

Figure 10:
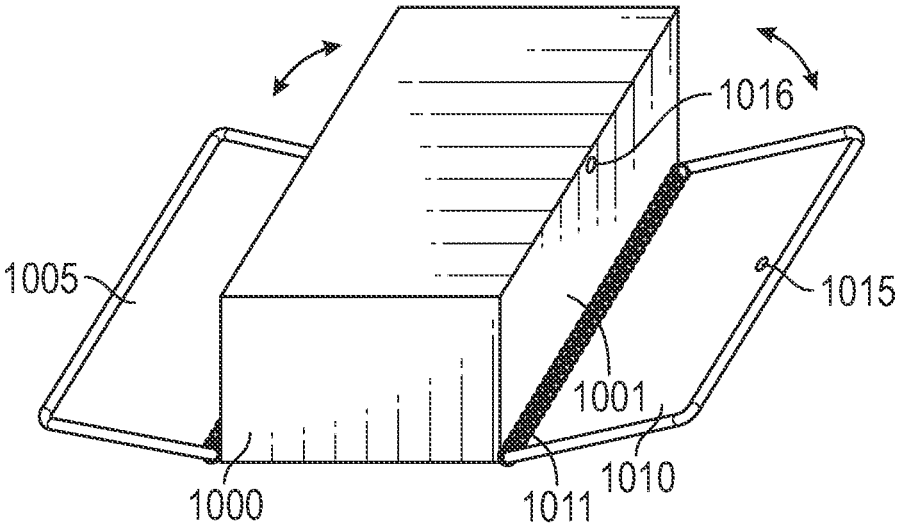
FIG. 10 shows a side system for a horizontal drawer.

In a similar way, the horizontal drawers such as 1000 shown in FIG. 10 can also have hinged sides. 1005 and 1010. Each of the sides is hinged on a hinge 1011. When folded into the upright position, a locking mechanism part 1015 holds the drawer tight against the side 1001 into a corresponding locking part 1016. Hence, the sides clip into the upright position before closing the drawer.

In one embodiment, the drawers can include removable drawer decals in a variety of prints, e.g. stick on vinyl decals.

In another embodiment, there can be a dual zone wine drawer with an adjustable rack to piled up plurality of differently sized items.

Figure 11:
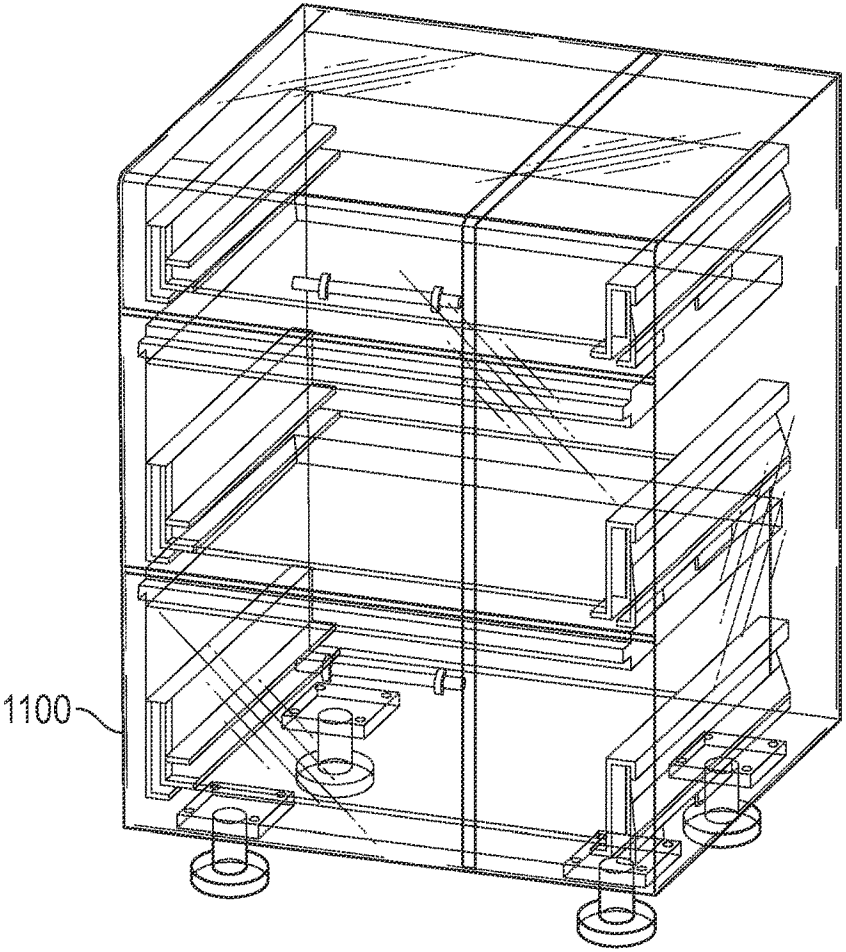
FIG. 11 shows a conversion kit for a refrigerator according to the system of the present application.

In one embodiment, the techniques described herein can be used as a conversion kit for a "conventional" refrigerator. FIG. 11 illustrates a slide in conversion kit 1100 that can slide into a refrigerator to retrofit a regular refrigerator into a new refrigerator with the drawer system. The conversion kit 1100 has similar drawers to a regular compartment fridge but varies with the size of the refrigerator.

Figure 12:
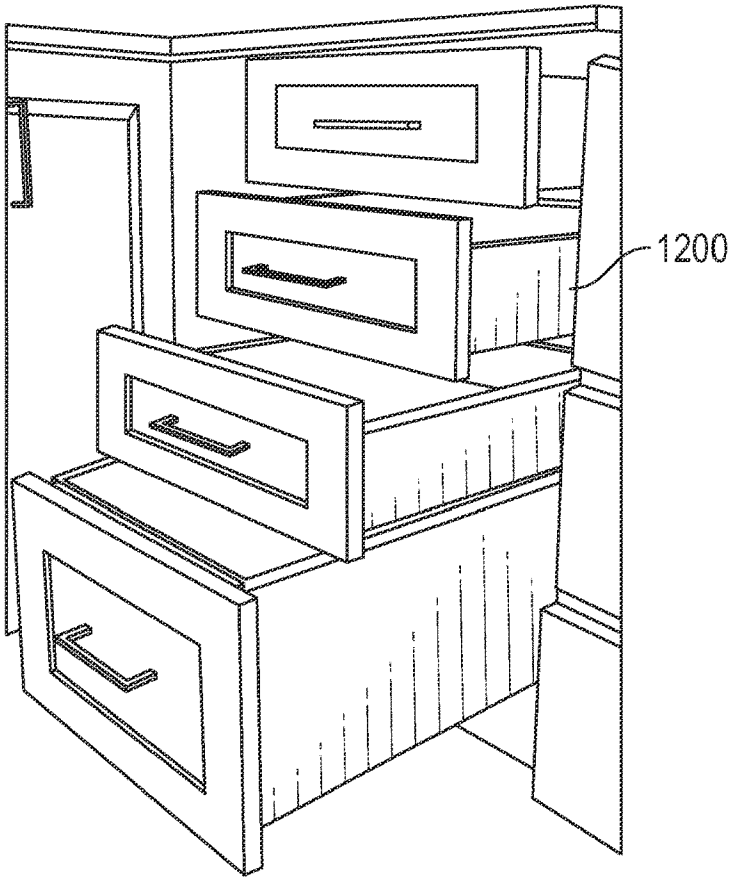
FIG. 12 shows an alternative conversion kit.

An optional conversion kit shown in FIG. 12 shows an optional drawer kit 1200 which can enable converting to drawer fridge-freezers in a compartment style. This avoids the issue with many small refrigerators that have limited shelving and are not set up properly to make the best use of space, leaving much of the space wasted.

The conversion kit preferably slides in and click mounts to the existing metal adjustable shelf rack brackets that are already found in the rear portion of most refrigerators. For refrigerators that do not include brackets of this type, an alternate mounting system can be used. The conversion kit is like a complete cabinet drawer, having at least one tall vertical section for open beverages such as wine and milk, and other small drawers for either parts.

By inserting the drawer system into the open space, a conversion kit allows better use of that space. The conversion kit slides and clip-mounts to the metal adjustable shelf brackets already mounted in the back of most refrigerators.

An alternative mounting system can be used in case brackets are not installed. The conversion kit includes at least one tall and vertical section for open beverages such as wine and milk, and can also include other sections.

In embodiments, each drawer can have sensors which detect when the drawers are open. In this way, each drawer can have its own separate door ajar alarm which is initiated by the controller when the drawer has been kept open for a determined time, such as one minute. When the door is open, the timer begins counting down, and the alarm will sound after 2 minutes. Each drawer can also have LED lighting, which can automatically illuminate when the drawer is opened.

Embodiments can be available in a variety of colors to include fingerprint resistant stainless steel, chalkboard, white, black, pewter (dark silver), red, dark blue, dark purple, dark pink, and a variety of pastel colors to name a few. It can have colored fronts, e.g., clear glass front or smoked glass front.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A refrigerator with separated sections, comprising:

a refrigeration system, including at least a compressor and a condenser, and having a cold air circulation system having its cold air cooled by the condenser;

a first compartment;

a second section, isolated from the first section;

a third section, isolated from the first and second sections;

a fourth section, isolated from the first, second, and third sections, where the first, second, third and fourth sections each define an area in the refrigerator having a storage portion therein, and each of the first, second, third and fourth sections being temperature insulated from the other sections;

where the cold air circulation system includes a cold air controlling gate for each of the first, second, third and fourth sections, a controller, separately controlling each of the first, second, third and fourth sections to be configured as refrigerator or freezer sections, and controlling refrigerant from the cold air circulation system separately to each of the first, second, third and fourth sections;

and where each of the first, second, third and fourth sections includes a thermostat that reports its temperature to the controller, and where the controller uses the temperature from the thermostat to control the cold air controlling gate for each of the first, second, third and fourth sections;

such that each of the first, second, third and fourth sections are configurable as either of refrigerators or freezers, and the temperature of each of the first, second, third and fourth sections are separately controlled to maintain a temperature, based on whether the section has been configured as a refrigerator or a freezer, and where each of the first, second, third and fourth sections can be opened and closed separately.

2. The refrigerator as in claim 1, wherein each of the each of the first, second, third and fourth sections have separately sliding drawers, opening to refrigerated areas which are temperature-isolated from the other each of the first, second, third and fourth sections.

3. The refrigerator as in claim 2, wherein each of the sliding drawers are separately electronically lockable, and are unlocked using a control associated with the refrigerator.

4. The refrigerator as in claim 3, wherein the control associated with the refrigerator is a control on the refrigerator, and requires a code to be entered to unlock a drawer once locked.

5. The refrigerator as in claim 4, wherein the control associated with the refrigerator is a control that is associated with multiple different sliding sections, and is programmable to indicate which of the sliding sections is being controlled by the control.

6. The refrigerator as in claim 5, wherein the control associated with the refrigerator is on an application running on a portable electronic device that communicates to the refrigerator.

7. The refrigerator as in claim 4, wherein there are separate controls associated with each of the compartments.

8. The refrigerator as in claim 2, wherein each of the compartments includes hinged sides, which hinge into an upright and locked position in order to allow the compartments to slide open and closed, and the hinged sides which fold down to form flat horizontal surfaces when in an extended position.

9. The refrigerator as in claim 2, where at least one of said sets of drawers has buffet trays therein, which are open trays with lids thereon.

10. A refrigerator that has multiple different separated compartments, each compartment being temperature isolated from other compartments, and each compartment being separately temperature controllable, Each compartment being opened by sliding out from the refrigerator; and a controller, that accepts controls for each compartment separately, each control indicating whether each compartment is configured as a refrigerator in a first mode and is configured as a freezer in a 2nd mode, and the controller controlling each of the compartments separately, to be cooled to a refrigerator temperature in the first mode and to be cooled to the freezer temperature in the second mode.

11. The refrigerator as in claim 10, where the compartments have locking mechanisms thereon, which are electronically controllable, and where the controller controls locking and unlocking the locking mechanisms.

* * * * *